US010322500B2

(12) United States Patent
Vandevelde

(10) Patent No.: US 10,322,500 B2
(45) **Date of Patent: *Jun. 18, 2019**

(54) HINGE PIN EXTRACTOR

(71) Applicant: John Vandevelde, Monroe, MI (US)

(72) Inventor: John Vandevelde, Monroe, MI (US)

(73) Assignee: John Vandevelde, Monroe, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/059,099

(22) Filed: Aug. 9, 2018

(65) Prior Publication Data

US 2018/0361548 A1 Dec. 20, 2018

Related U.S. Application Data

(63) Continuation-in-part of application No. 15/200,671, filed on Jul. 1, 2016, now Pat. No. 10,046,446.

(60) Provisional application No. 62/196,320, filed on Jul. 24, 2015.

(51) Int. Cl.
*E05D 3/02* (2006.01)
*B25B 27/04* (2006.01)

(52) U.S. Cl.
CPC ..... *B25B 27/04* (2013.01); *E05D 3/02* (2013.01)

(58) Field of Classification Search
CPC ..... B25B 27/04; E05D 3/02
See application file for complete search history.

(56) References Cited

U.S. PATENT DOCUMENTS 6,922,880 B1 * 8/2005 Green ..... B25B 27/04 29/267
10,046,446 B2 * 8/2018 Vandevelde ..... B25B 27/04

* cited by examiner

*Primary Examiner* — David P Bryant
*Assistant Examiner* — Nirvana Deonauth
(74) *Attorney, Agent, or Firm* — Black, McCuskey Souers & Arbaugh LPA

(57) ABSTRACT

A hinge pin extractor operable to urge a pin out of engagement with a hinge assembly can include a base, a receiver, a plunger, and a lever. The receiver can be mounted to the base to engage a portion of the hinge assembly. The plunger can be mounted to the base and configured to urge a pin of the hinge assembly out of engagement during movement from the first end limit of travel to the second end limit of travel. The lever can be pivotally engaged with the base and disposed to engage the plunger to move the plunger along the rectilinear path. The lever and the base and the plunger can be engaged such that pivoting motion of the lever is transmitted to rectilinear motion of the plunger through a single, fixed fulcrum positioned directly in the base.

20 Claims, 18 Drawing Sheets

HINGE PIN EXTRACTOR

CROSS-REFERENCE TO RELATED APPLICATIONS

This application claims the benefit of U.S. patent application Ser. No. 15/200,671 for a HINGE PIN EXTRACTOR, filed on 1 Jul. 2016, which is hereby incorporated by reference in its entirety, which itself claims the benefit of U.S. Provisional Patent Application Ser. No. 62/196,320 for a HINGE PIN EXTRACTOR, filed on 24 Jul. 2015, which is also hereby incorporated by reference in its entirety.

BACKGROUND

1. Field

The present disclosure relates to a tool for removing the pin of a hinge assembly.

2. Description of Related Prior Art

U.S. Pat. No. 6,922,880 discloses a HINGE PIN-REMOVING TOOL. The hand tool is adapted to remove a hinge pin from a hinge on a door or the like. The hinge pin is pushed out of the hinge by application of force to one end of the hinge pin in a direction that is aligned with the longitudinal axis of the hinge pin. The hand tool includes a main body that is removably attached to the hinge and a hinge pin-engaging unit on the main body. The hinge pin-engaging unit includes a drive pin slidably attached to the main body and a lever arm that is attached to the drive pin at a distal end of the lever arm and is also pivotally attached to the main body by a fulcrum that is attached to the lever arm between the distal end of the lever arm and a proximal end of the lever arm to form a first class lever. A handle is threadably attached to the lever arm adjacent to the proximal end of the lever arm.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A hinge pin extractor operable to urge a pin out of engagement with a hinge assembly can include a base, a receiver, a plunger, and a lever. The receiver can be mounted to the base and can be configured to engage at least one of a first plate, a second plate, and at least one knuckle of the hinge assembly. The receiver can be sized to allow pass-through of the pin as the pin exits the at least one knuckle. The plunger can be mounted to the base for movement along a rectilinear path between a first end limit of travel and a second end limit of travel and can be configured to urge the pin of the hinge assembly out of engagement with the at least one of the knuckles during movement from the first end limit of travel to the second end limit of travel. The lever can be pivotally engaged with the base and can be disposed to engage the plunger to transmit motion to the plunger and thereby move the plunger along the rectilinear path. The lever and the base and the plunger can be engaged such that pivoting motion of the lever is transmitted to rectilinear motion of the plunger through a single, fixed fulcrum positioned directly in the base.

BRIEF DESCRIPTION OF THE DRAWINGS

The detailed description set forth below references the following drawings.

DETAILED DESCRIPTION

Figure 1:
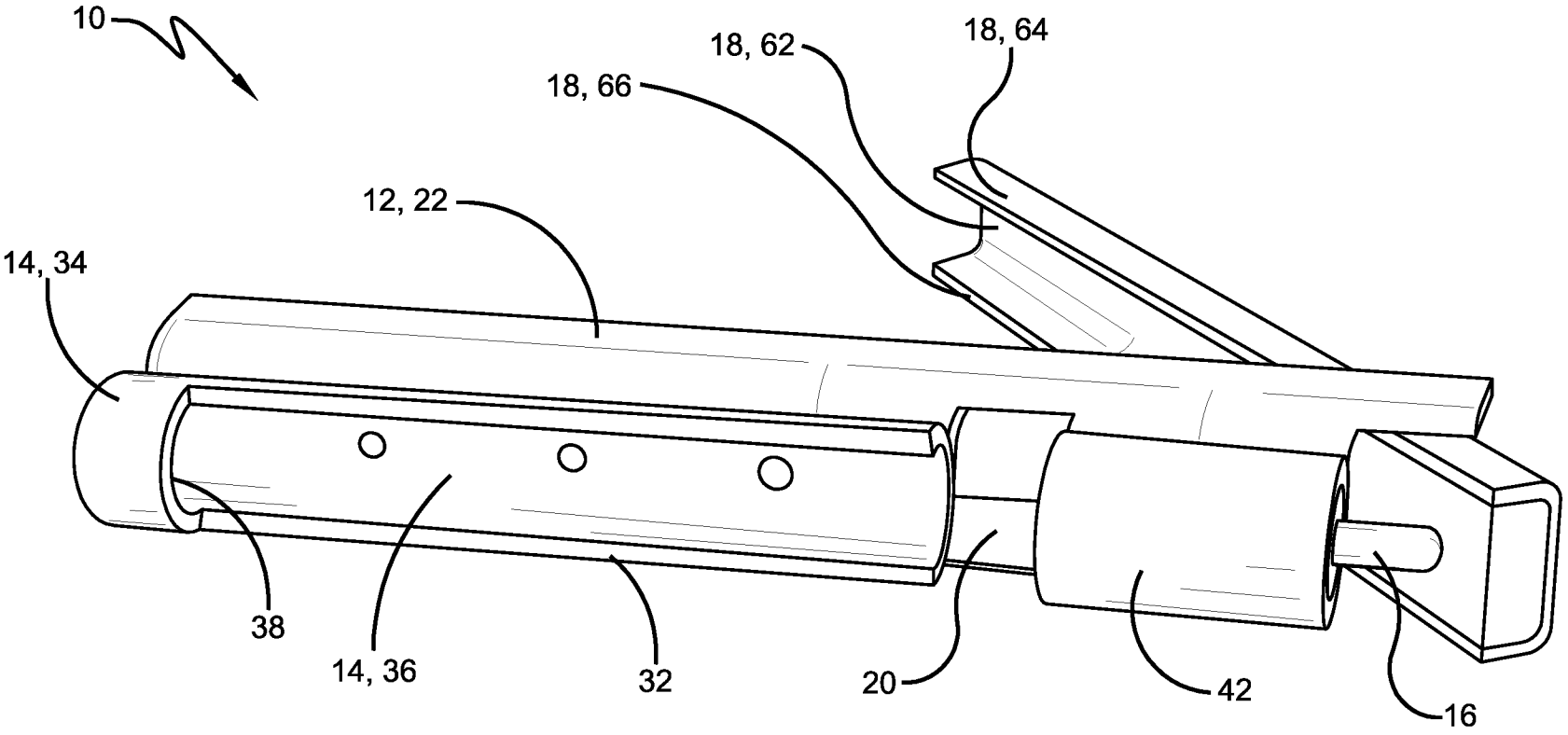
FIG. 1 is a first perspective view of a hinge pin extractor according to an exemplary embodiment of the present disclosure, taken generally from of a front or hinge-facing side of the hinge pin extractor.
Figure 2:
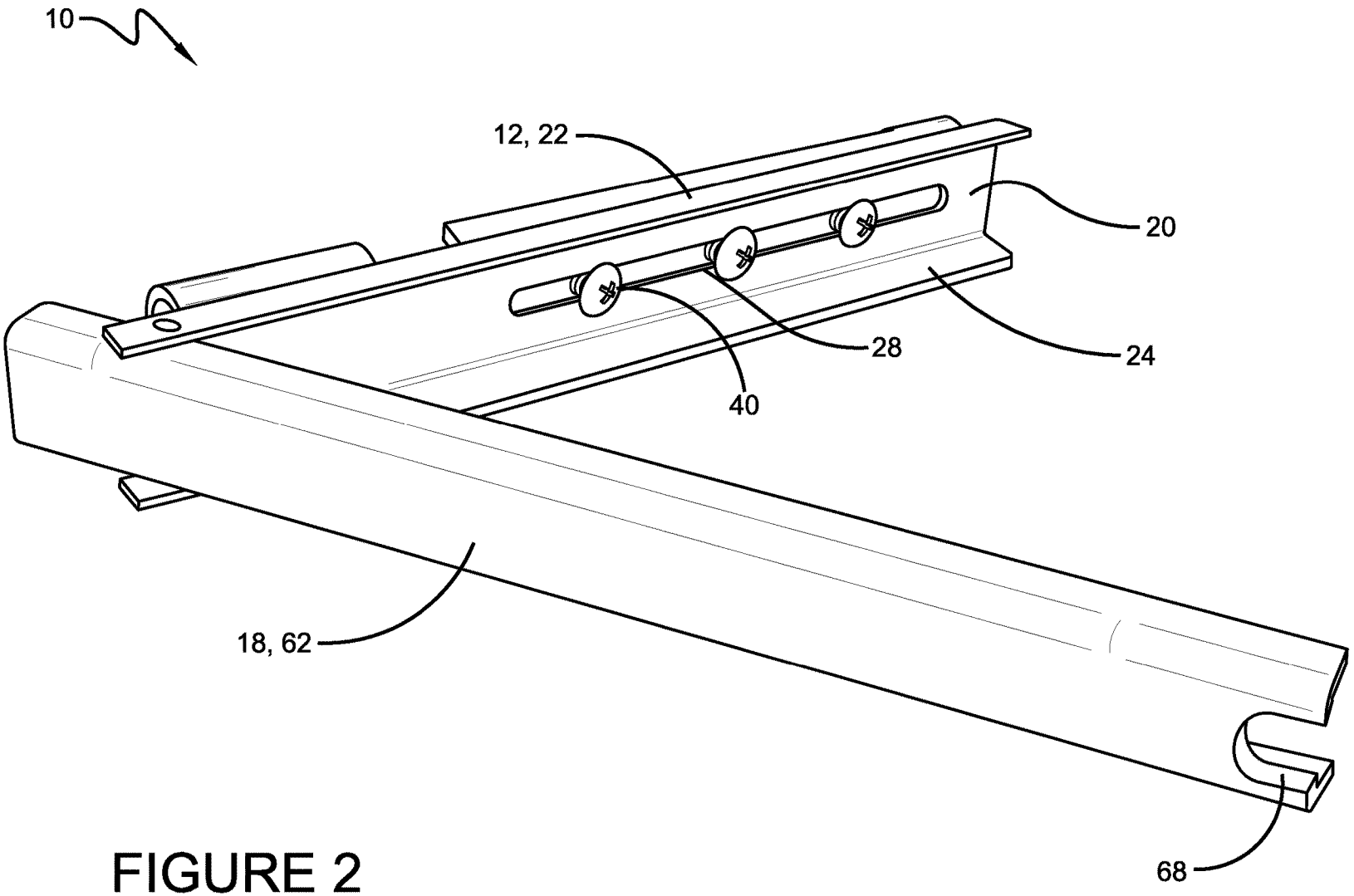
FIG. 2 is a second perspective view of the hinge pin extractor shown in FIG. 1, taken from of a generally rear side of the hinge pin extractor.
Figure 3:
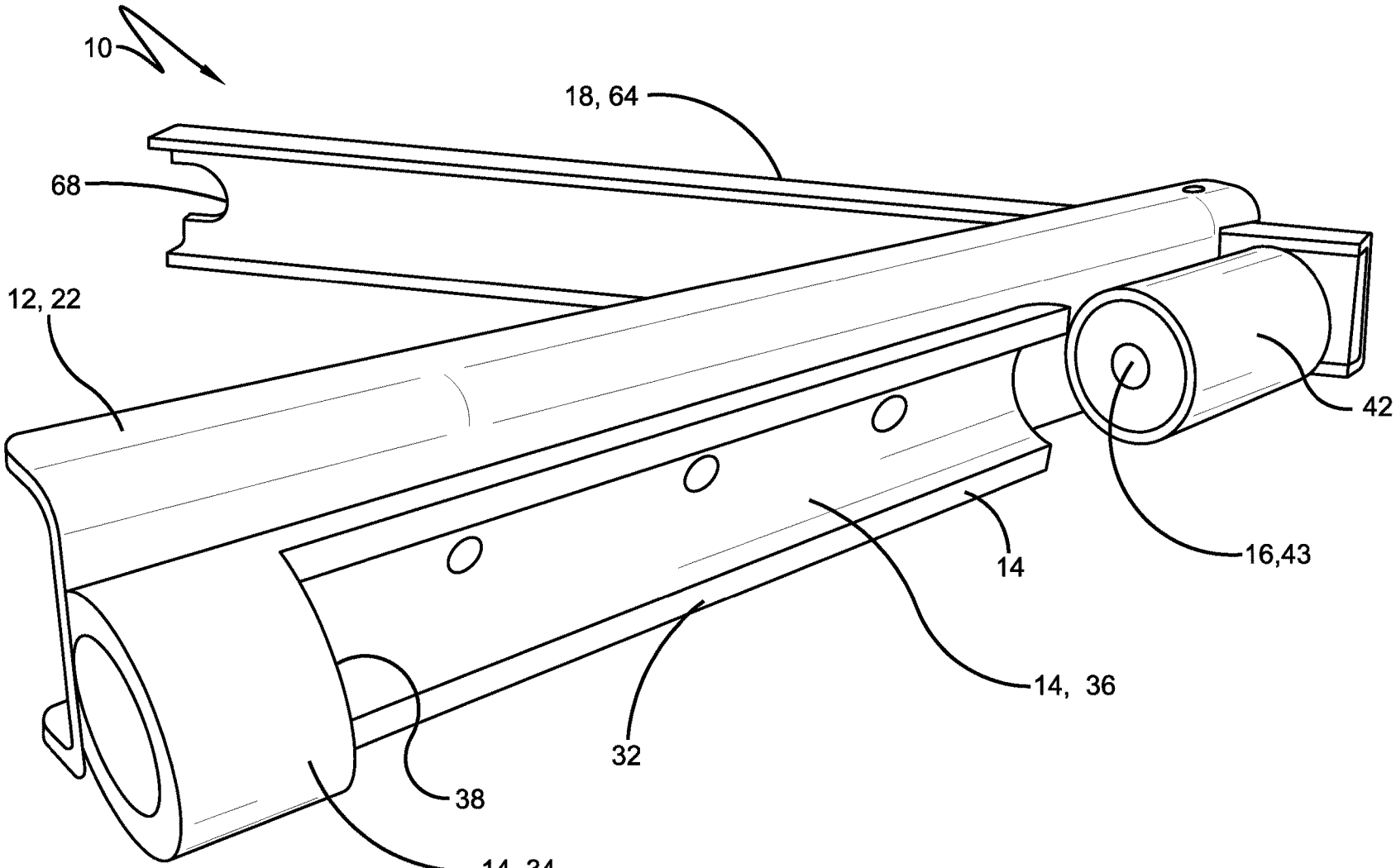
FIG. 3 is a third perspective view of the hinge pin extractor shown in FIGS. 1 and 2, taken from of a generally front side of the hinge pin extractor.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiment described below, can provide a hinge pin extraction tool that provides several significant advantages over the prior art. The exemplary embodiment of the present disclosure can extract hinge pins from various size hinge assemblies. The exemplary embodiment of the present disclosure can also be sized smaller than prior devices because of the arrangement of the fulcrum. A fulcrum is the point on which a lever rests or is supported and on which it pivots. The exemplary embodiment of the present disclosure also defines an integrated tool rather than tool requiring assembly before use. The exemplary embodiment of the present disclosure can also be used on both open and closed doors.

Referring now to the Figures, a hinge pin extractor 10 can be operable to urge a pin 82 out of engagement with a hinge assembly 84 in that the pin 82 can be moved so that a head 102 of the pin 82 becomes spaced from a top-most knuckle 90 of the hinge assembly 84. The hinge assembly 84 can include a first leaf or plate 86 that can define a door-side plate, a second leaf or plate 88 that can define a frame-side plate, and knuckles 90-98 that are each integral with one of the plates 86, 88. The hinge pin extractor 10 can include a base 12, a hinge receiver 14, a plunger 16, and a lever 18.

The base 12 can define a channel profile with a bottom portion 20, a first side portion 22 extending transverse to the bottom portion 20, and a second side portion 24 extending transverse to the bottom portion 20 from a side of the bottom portion 20 opposite the first side portion 22. The first side portion 22 and the second side portion 24 can extend past the bottom portion 20 at one end of the base 12, resulting in a gap referenced at 26 in FIG. 6. The gap 26 is between an end 33 of the bottom portion 20 and ends of the side portions 22, 24 (referenced on the side portion 22 at 35). The base 12 can also include a slot 28 in the bottom portion 20.

The receiver 14 can be mounted to the base 12 and can be configured to engage at least one portion of the hinge assembly 84. The exemplary hinge receiver 14 is generally cylindrical and hollow. The receiver 14 can be centered on a longitudinal axis 104.

Figure 4:
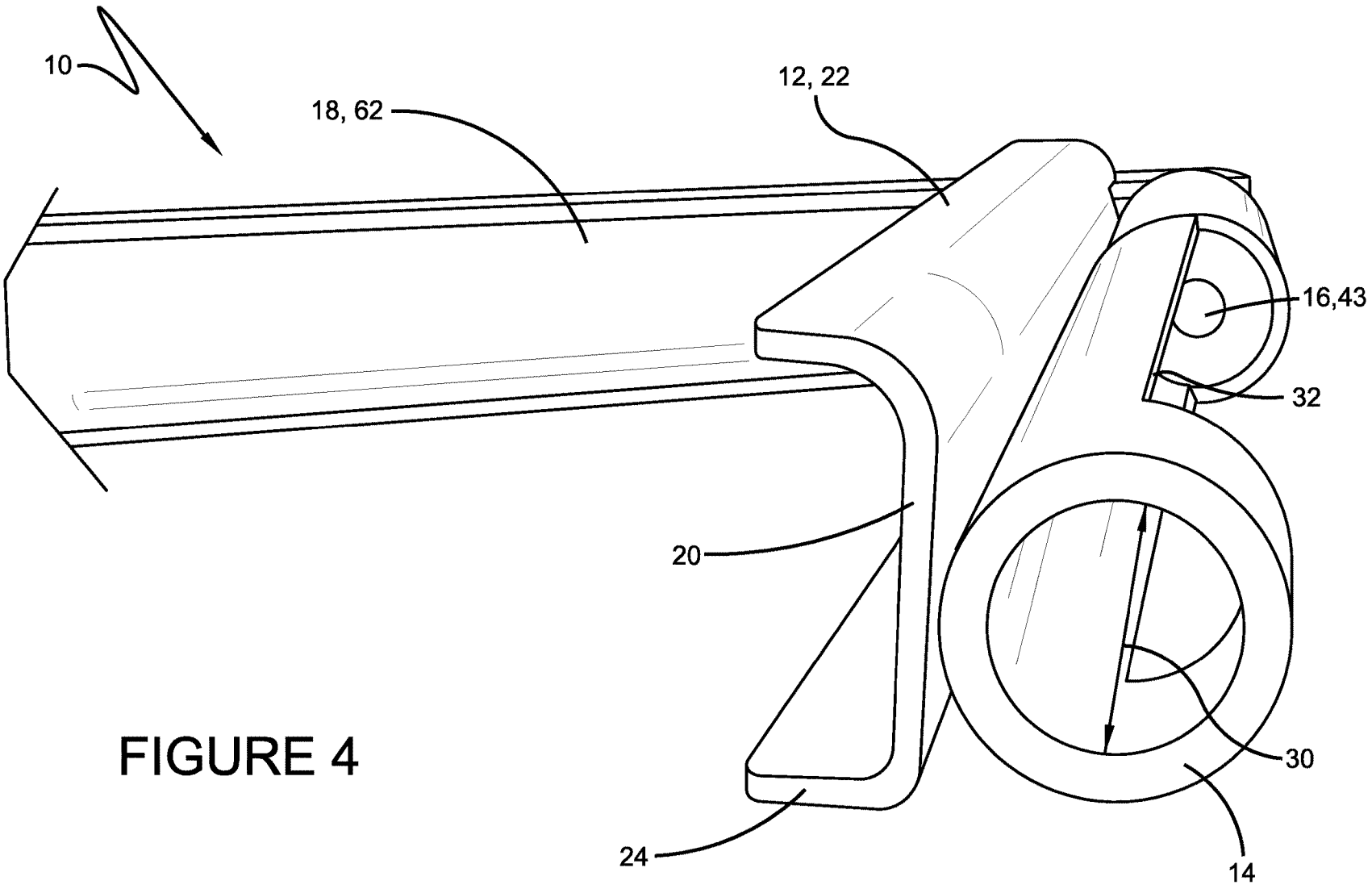
FIG. 4 is a fourth perspective view of the hinge pin extractor shown in FIGS. 1-3, taken from of a generally top side of the hinge pin extractor.
Figure 5:
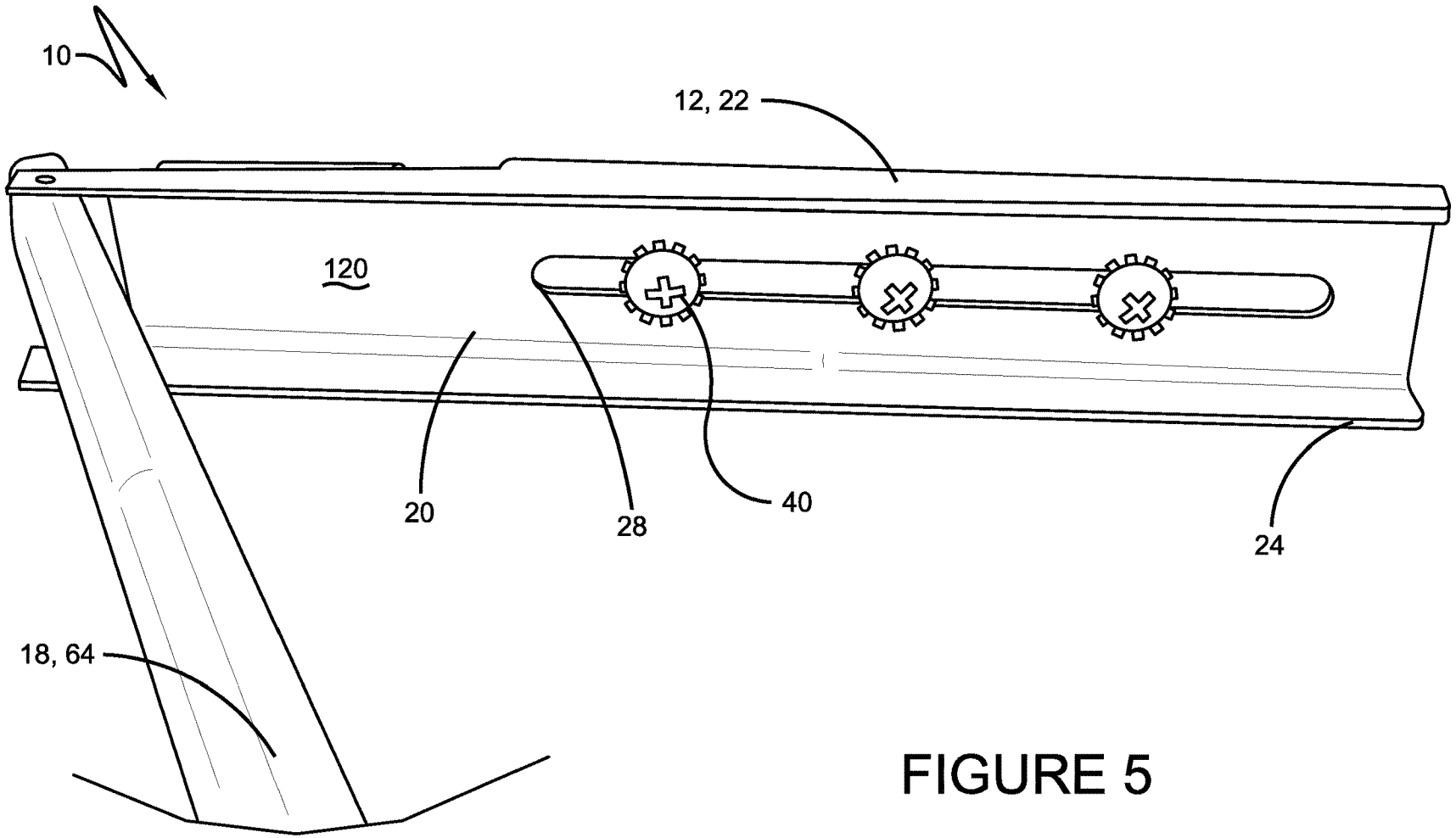
FIG. 5 is a fifth perspective view of the hinge pin extractor shown in FIGS. 1-4, taken from of a generally rear side of the hinge pin extractor.
Figure 10:
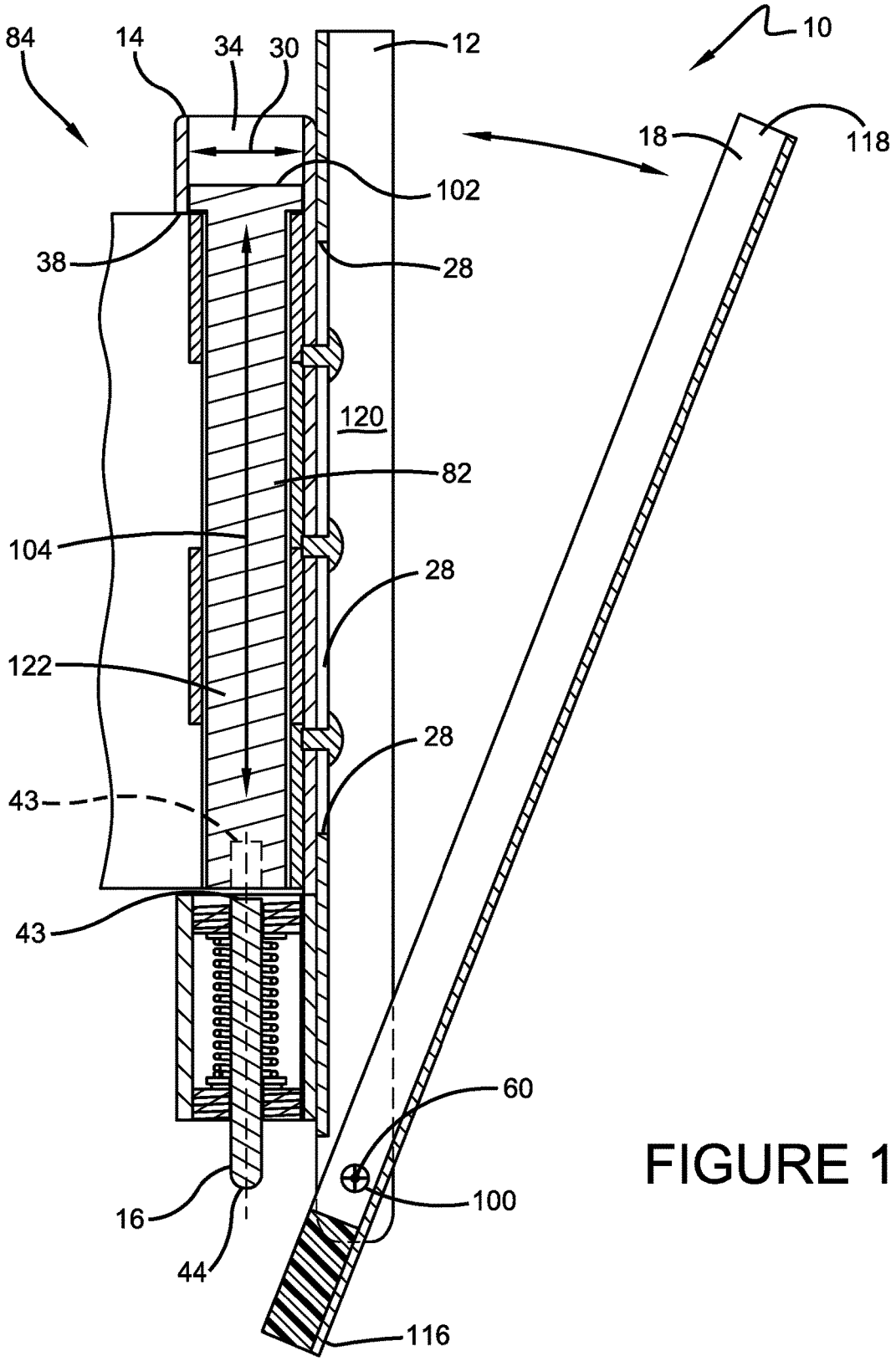
FIG. 10 is a cross-sectional view of the hinge pin extractor shown in FIGS. 1-9 taken in a plane containing a longitudinal axis of the hinge receiver.

The receiver 14 can include a tubular or first portion 34 configured to surround a head of the pin 82, as best shown in FIG. 10. An inner diameter 30 (referenced in FIGS. 4 and 10) of the tubular portion 34 of the hinge receiver 14 can be sized to allow pass-through of the head 102 of the hinge pin 82. This is shown in FIG. 10.

A notch 32 can be defined by or formed in the hinge receiver 14, the notch 32 resulting in a first portion 34 of the hinge receiver 14 being more cylindrical than a second portion 36. The exemplary first portion 34 can be fully cylindrical and the second portion 36 can be less than fully cylindrical. The tubular portion 34 extends a first part of the overall length of the receiver 14 along the longitudinal axis 104 and thus has a ring cross-section in planes perpendicular to the longitudinal axis 104. The exemplary second portion 36 extends a second part of the overall length of the receiver 14 along the longitudinal axis 104 and has a c-shaped cross-section in planes perpendicular to the longitudinal axis 104. The second part of the length can be at least as long as the first part of the length or can be longer than the first part of the length. In the exemplary embodiment, the second part of the length is longer than the first part of the length.

Figure 12:
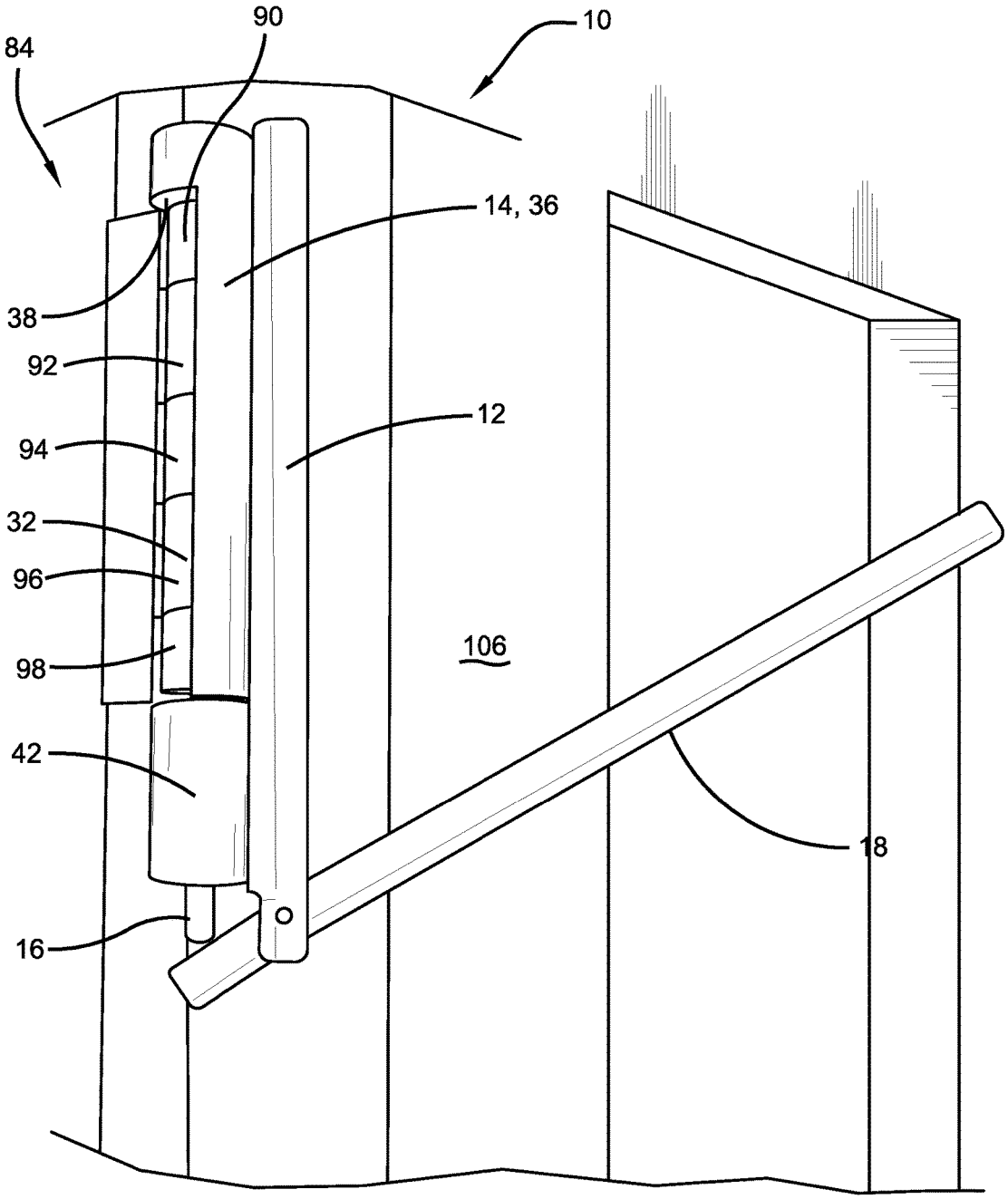
FIG. 12 is a tenth perspective view of the hinge pin extractor shown in FIGS. 1-11, taken from of a generally lateral side of the hinge pin extractor and showing the hinge pin extractor in a working configuration.
Figure 13:
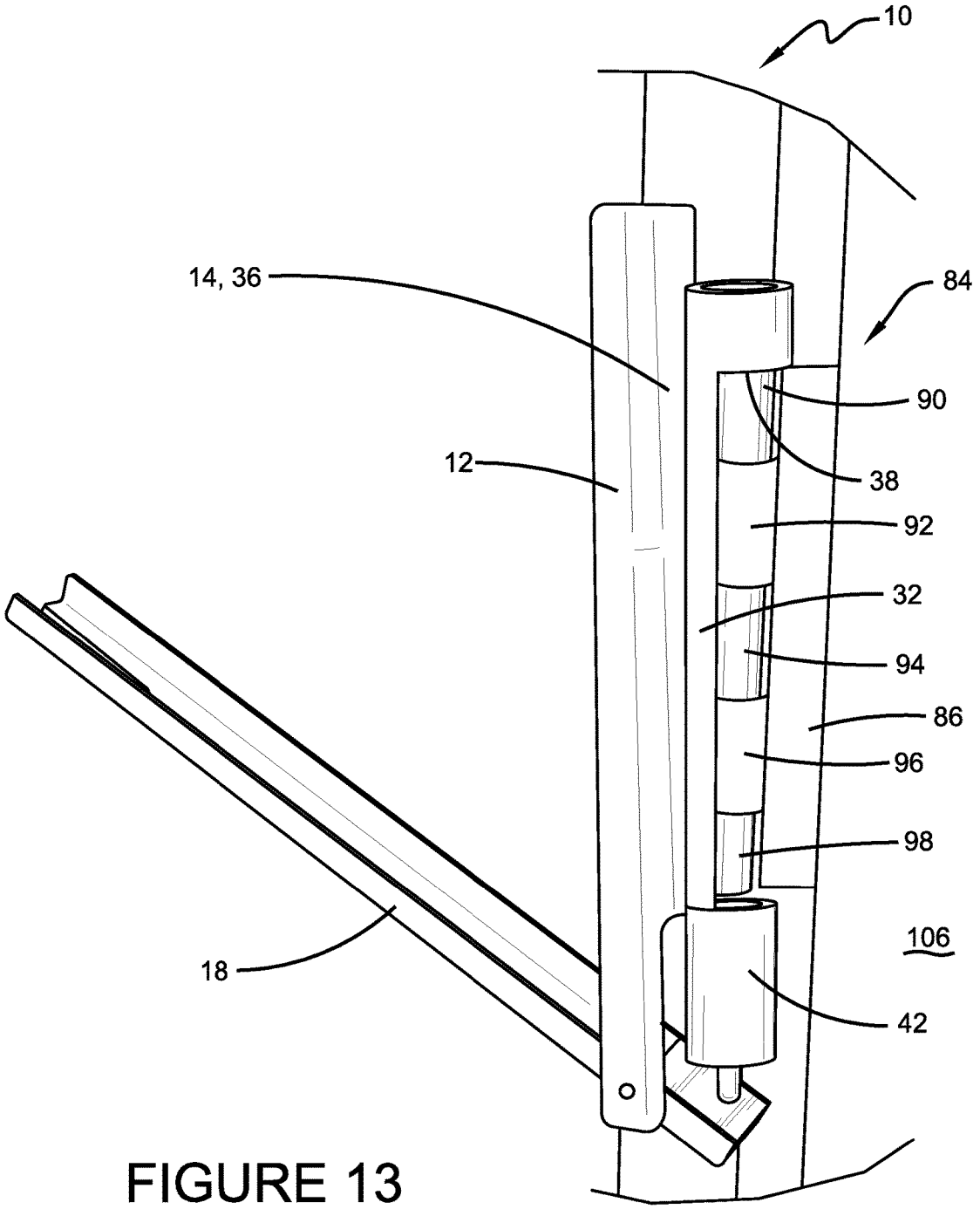
FIG. 13 is an eleventh perspective view of the hinge pin extractor shown in FIGS. 1-12, taken from of a generally lateral side of the hinge pin extractor and showing the hinge pin extractor in a working configuration.

An edge 38 can defined at the junction between the first portion 34 and the second portion 36. The edge 38 can extend one hundred and eighty degrees, less than one hundred and eighty degrees, or more than one hundred and eighty degrees. The exemplary edge 38 extends approximately one hundred and eighty degrees and allows the hinge pin extractor 10 to rest on top surfaces (or "upwardly-facing" surfaces) of the hinge plates 86, 88 of the hinge assembly 84 when a door 106 is open or when the door 106 is closed, as shown in FIGS. 10, 12 and 13. FIG. 12 shows the door 106 partially open and FIG. 13 shows the door 106 closed. The edge 38 is a downwardly-facing surface configured to engage top edges of the first plate 86 and the second plate 88 of the hinge assembly 84. The exemplary edge 38 extends continuously about an arcuate path of at least one hundred and eighty degrees. The exemplary downward surface defined by the edge 38 is without break or an edge resulting from an abrupt change of slope. The exemplary downward surface defined by the edge 38 is continuous and defined in a single plane. The exemplary arcuate path extends about the longitudinal axis 104.

The receiver 14 can be mounted to the base 12 at a midpoint of the c-shaped cross-section of the second portion 36. The second portion 36 can partially surround and "cup" at least one of the knuckles 90-98 when the hinge pin extractor 10 is mounted on the hinge assembly 48 for use. The hinge receiver 14 can engaged with the base 12 such that the position of the hinge receiver 14 along the length of the base 12 is adjustable. The distance between the receiver 14 and the first end limit of travel of the plunger 16 in the exemplary embodiment is therefore adjustable. The hinge pin extractor 10 can thus accommodate hinges of different sizes.

By way of example and not limitation, the hinge receiver 14 can be engaged with the base 12 through fasteners, such as fastener 40, extending through the slot 28. The fasteners can be received in threaded apertures defined in the second portion 36. Locking washers can be disposed between the heads of the fasteners and the bottom portion 20 to prevent slippage. The fasteners 40 can be loosened to allow the exemplary receiver 14 to be positioned in any one of a plurality of different positions along the slot 28. The exemplary receiver 14 is infinitely positionable within the slot 28 between the ends of the slot 28. The fasteners 40 are tightenable and can be tightened to selectively fix the receiver 14 in any one of the plurality of positions.

The plunger 16 mounted to the base 12 for movement along a rectilinear path between a first end limit of travel and a second end limit of travel. The exemplary rectilinear movement of the plunger 16 is along the longitudinal axis 104. The plunger 16 can extend between a first end 43 and a second end 44. The plunger 16 can be configured to urge the pin 82 of the hinge assembly 84 out of engagement with the at least one of the knuckles 90-98 during movement from the first end limit of travel to the second end limit of travel. The travel of the plunger 16 may not fully separate the pin 82 from any one of the knuckles 90-98, however length of travel of the plunger 16 can allow the head 102 to move away from the top-most knuckle 90 to create space for insertion of a prying tool into the gap created between the head 102 and the knuckle 90. In FIG. 10, the plunger 16 is shown in solid line in the first end limit of travel. The first end 43 is shown in phantom to indicate its position when the plunger 16 is at the second end limit of travel.

The plunger 16 can be mounted in a plunger sleeve 42. The sleeve 42 can be mounted to the base 12 and extend between a first end 108 and a second end 110. The exemplary plunger sleeve 42 can be fixedly engaged with the base 12. By way of example and not limitation, the plunger sleeve 42 can be fixedly engaged with the base 12 by welding as done in the exemplary embodiment.

Figure 6:
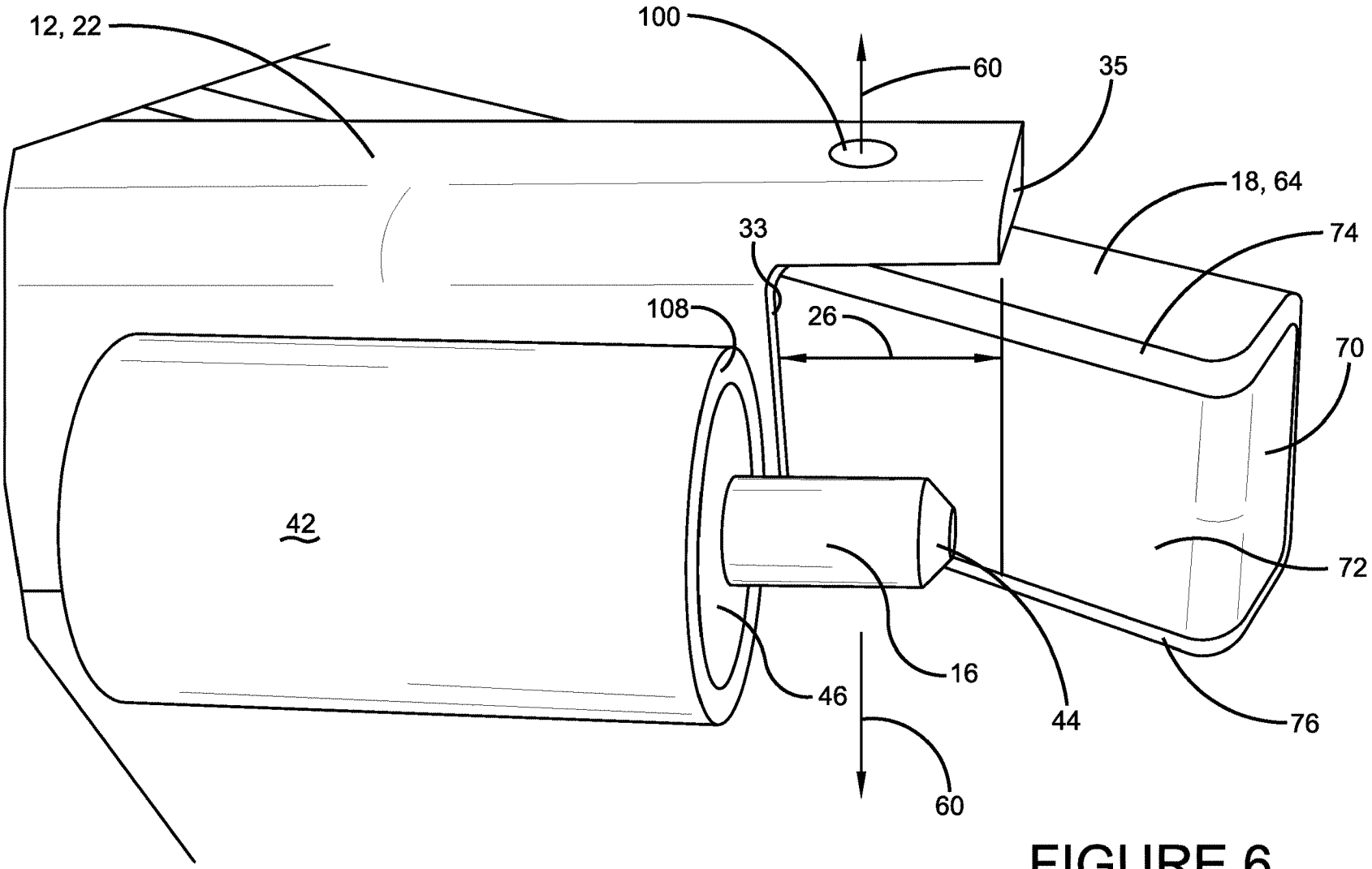
FIG. 6 is a sixth perspective view of a portion of the hinge pin extractor shown in FIGS. 1-5, taken from of a generally front side of the hinge pin extractor and focused on a plunger assembly of the hinge pin extractor.

The plunger 16 can be movably associated with the base 12 to travel along a rectilinear path between first and second end limits of travel. A rectilinear path is a path without curvature. The plunger 16 can move along a rectilinear path that is collinear with its longitudinal axis. The rectilinear path can also be collinear with the longitudinal axis of a hinge pin being extracted. An end limit of travel can be defined by any point along the length of the plunger 16. For example, the second end 44 of the plunger 16 is shown in FIG. 6 at the first end limit of travel. A second end limit of travel of the plunger 16 can be defined when the end 44 is flush with a cap 46 enclosing one end of the plunger sleeve 42. As will be discussed below, this can occur when the lever 18 is fully pivoted relative to the base 12.

Figure 11:
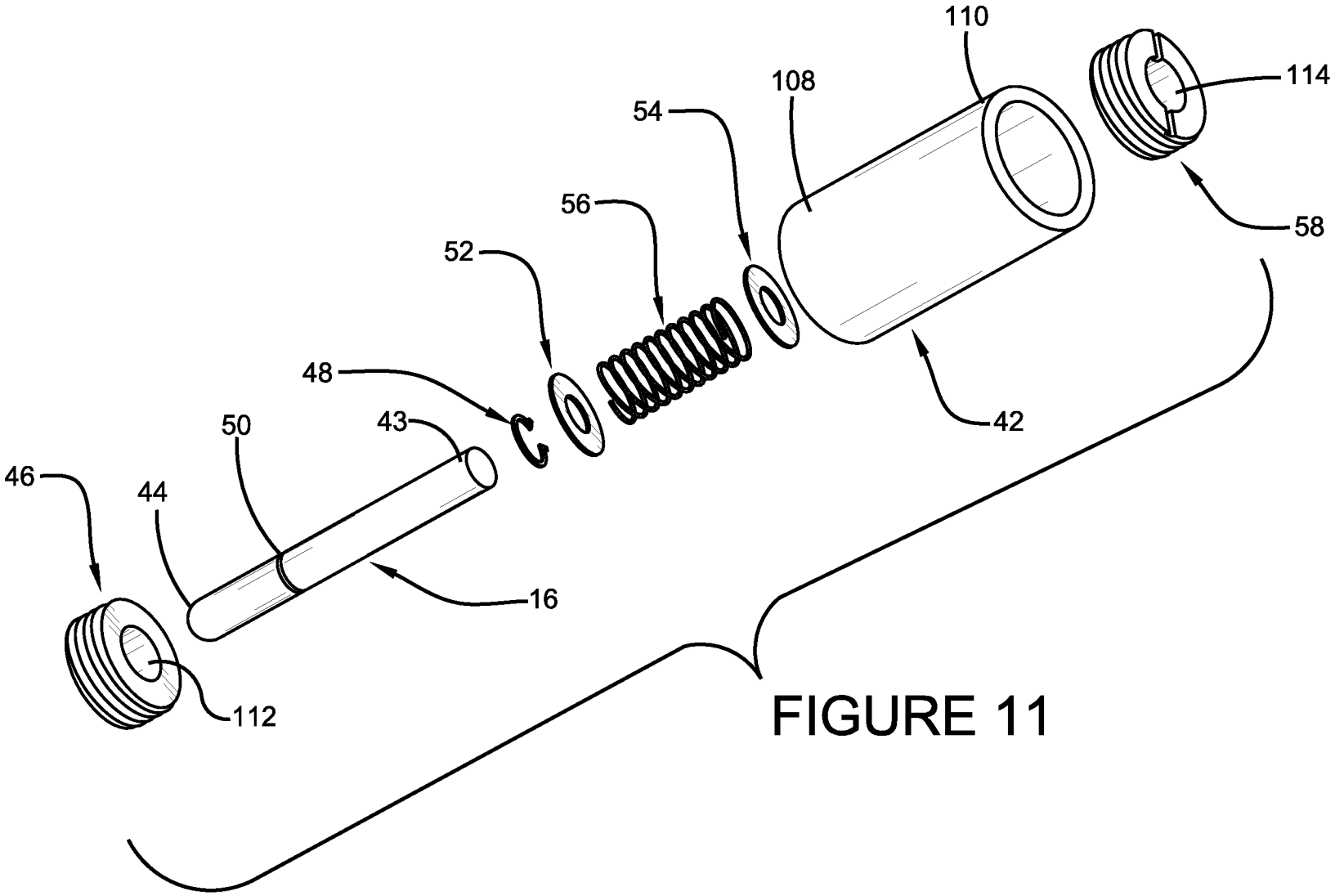
FIG. 11 is an exploded view of the plunger assembly of the hinge pin extractor shown in FIGS. 1-10.

FIGS. 10 and 11 illustrate components internal of the plunger sleeve 42. A c-clip 48 can be mounted in a groove 50 of the plunger 16. The c-clip 48 can define a shoulder fixedly engaged with the plunger 16 and positioned in the sleeve 42. In various embodiments of the present disclosure, a shoulder can be integrally-formed on plunger 16 or can be a separate structure mounted on the plunger 16, such as c-clip 48. Washers 52, 54 can define seats for a spring 56. The exemplary spring 56 is operably positioned between the c-clip 48 and the end cap 58 within the sleeve 42. The spring 56 in cooperation with the washers 52, 54 and c-clip 48 can bias the plunger 16 to the first end limit of travel. The c-clip 48 can prevent the plunger 16 from exiting the plunger sleeve 42 through the cap 46.

The components internal of the plunger sleeve 42 can be enclosed with the cap 46 and a cap 58. The first end cap 46 can have a first aperture 112 and substantially close the first end 108 of the sleeve 42. The second end cap 58 can have a second aperture 114 and substantially close the second end 110 of the sleeve 42. The exemplary plunger 16 is disposed in the sleeve 42 and is sized to pass through both of the first aperture 112 and the second aperture 114. The first and second ends 43, 44 of the plunger 16 can be sized differently or the same. The end 44 can pass through the first aperture 112 and the end 43 can pass through the aperture 114.

The lever 18 extends between a first end 116 proximate to the plunger 16 and a second end 118 spaced from the first end 116 and from the plunger 16. The lever 18 can be pivotally engaged with the base 12 through the fulcrum 100, pivoting about axis 60. The lever 18 can be disposed to engage the plunger 16 to transmit motion to the plunger 16 and thereby move the plunger 16 along the rectilinear path. Movement of the plunger 16 can be accomplished through a single pivot axis, rather than multiple pivot axes.

The exemplary lever 18 and the exemplary base 12 and the exemplary plunger 16 are engaged such that pivoting motion of the lever 18 is transmitted to rectilinear motion of the plunger 16 through the fulcrum 100 defined in the base 12. The fulcrum 100 of the lever 18 is fixedly disposed on the base 12 whereby the hinge pin extractor 10 can also be sized smaller. The exemplary fulcrum 100 is a single fulcrum 100. In the exemplary embodiment, the lever 18 can generate a nine-to-one mechanical advantage. The exemplary axis 60 extends across and overlaps the gap 26.

Figure 7:
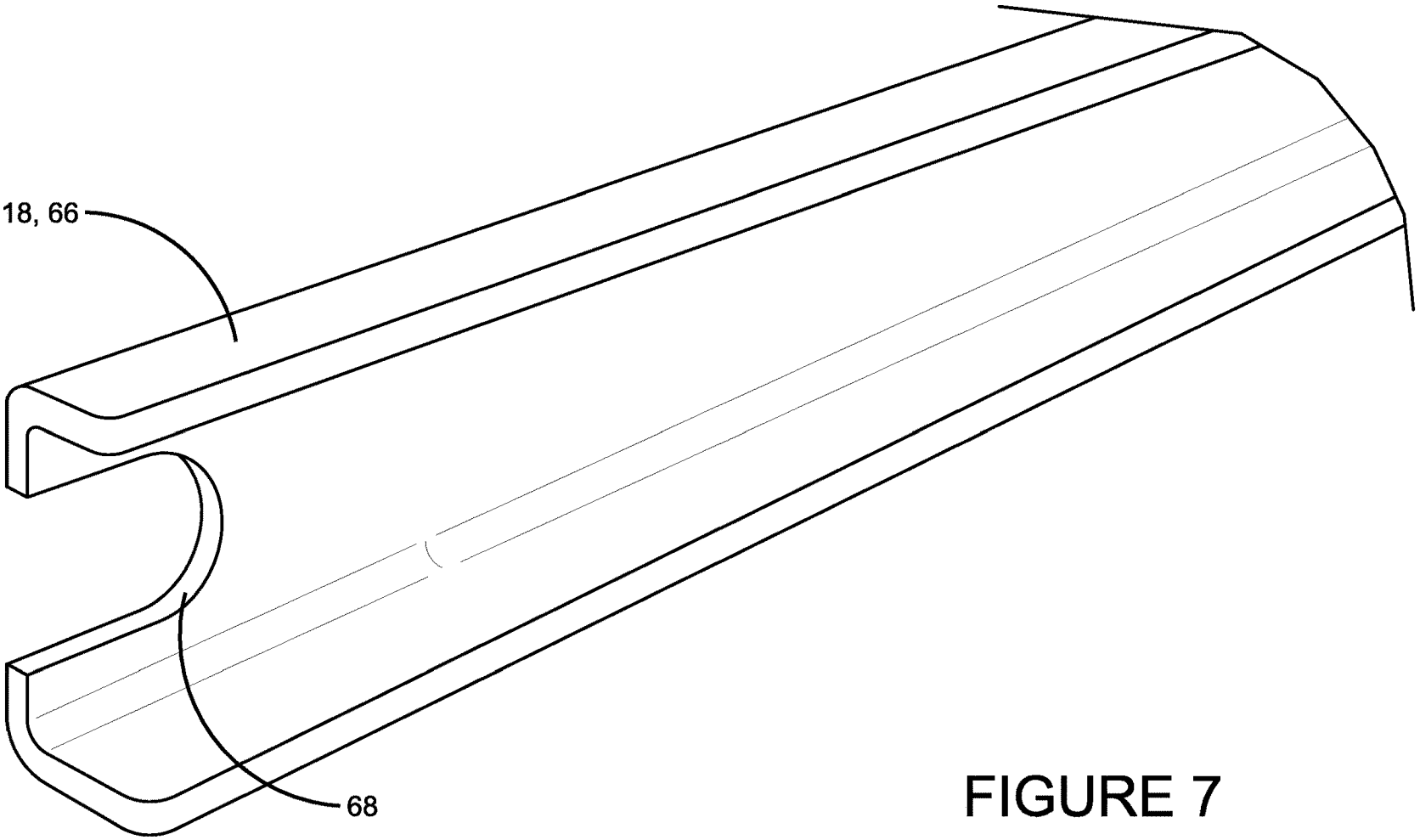
FIG. 7 is a seventh perspective view of a portion of the hinge pin extractor shown in FIGS. 1-6, taken from of a generally top side of the hinge pin extractor and focused on a distal end of a lever of the hinge pin extractor.
Figure 8:
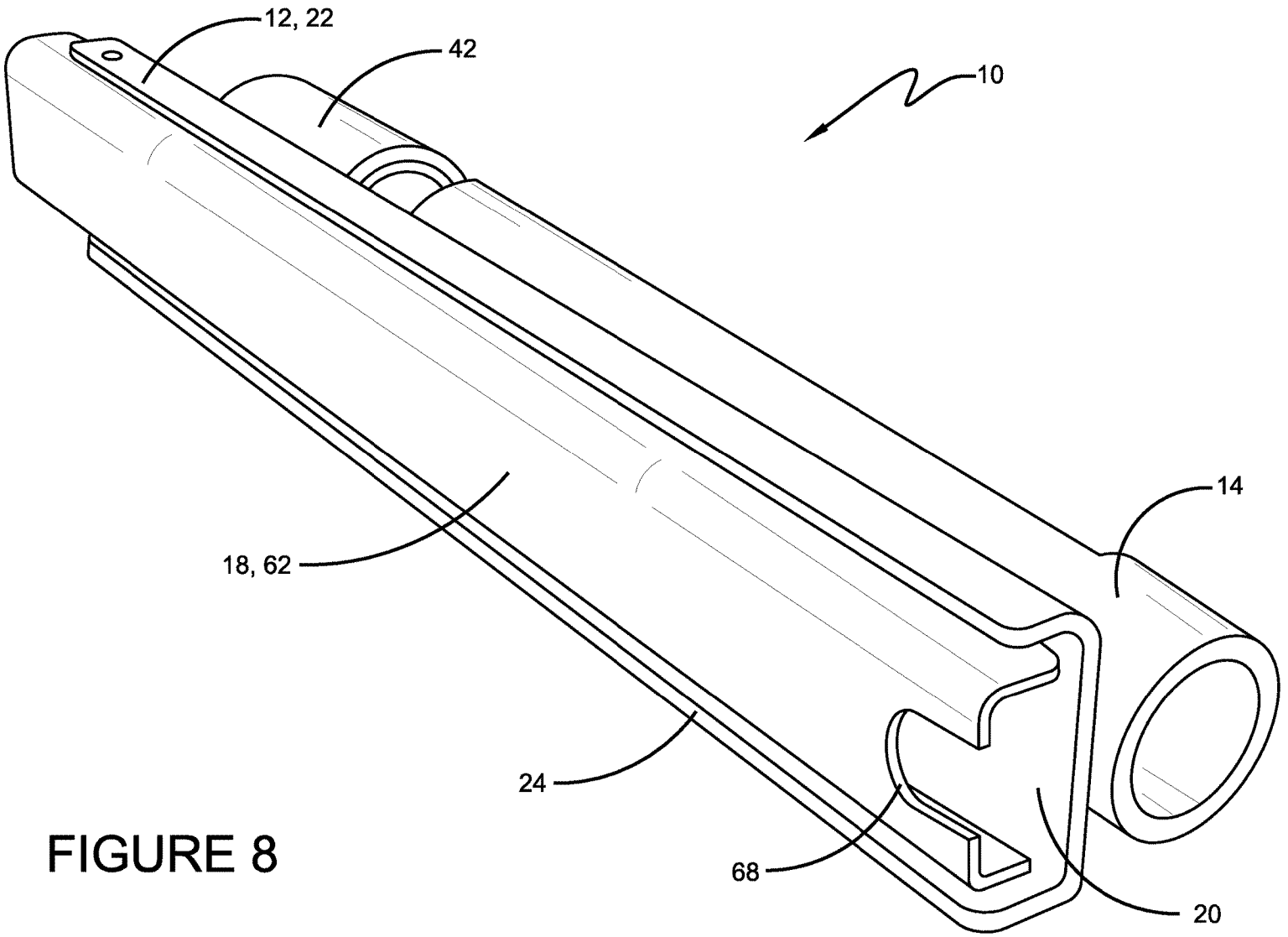
FIG. 8 is a eighth perspective view of the hinge pin extractor shown in FIGS. 1-7, taken from of a generally rear side of the hinge pin extractor and showing the hinge pin extractor in a standby configuration.

The lever 18 can define a channel profile with a bottom portion 62, a first side portion 64 extending transverse to the bottom portion 62, and a second side portion 66 extending transverse to the bottom portion 62 from a side of the bottom portion 62 opposite the first side portion 64. As best show in FIG. 7, a notch 68 can be defined in the lever 18 at the second end 118. After the head 102 of a hinge pin 82 has been forced upwardly away from the knuckle 90 of the hinge assembly 84 by movement of the plunger 16, the notch 68 can be moved to partially surround the shank 122 of the hinge pin 82. The lever 18 can then be moved upward against the head 102 to fully remove the hinge pin 82. The bottom portion 20 and the side portions 22, 24 of the base 12 cooperate to define a recess 120 sized to receive the lever 18 when the lever 18 is not in use. As shown by FIG. 8, the notch 68 is exposed and usable to partially encircle the pin 82 when the lever 18 has been received in the recess 120. Thus, after the head 102 of a hinge pin 82 has been forced upwardly away from the knuckle 90 of the hinge assembly 84 by movement of the plunger 16, the lever 18 can be pivoted back into the recess 120 and the notch 68 can still be moved to partially surround the shank 122 of the hinge pin 82. The entire hinge pin extractor 10 can then be moved upward against the head 102 to fully remove the hinge pin 82.

The lever 18 can include a bushing 70 having a substantially flat, planar shape. The nylon bushing 70 can be positioned in the channel profile of the lever 18. As best shown in FIG. 6, the bushing 70 can be sized such that a top surface 72 of the bushing 70 is flush with top edges 74, 76 of the first and second side portions 64 and 66.

The lever 18 and the plunger 16 engage one another in a cam-cam follower arrangement, rather than being positively interconnected, such as through a pin or fastener. A cam-cam follower arrangement involves one structure pushing another structure to move that structure, while being positively interconnected allows one structure to push and pull another structure. Movement can be forced in two opposite directions when two structures are positively interconnected. The exemplary lever 18 and exemplary plunger 16 can engage one another such that at least a portion of the plunger 16 slides across a portion of the lever 18 during the transmission of motion. When the lever 18 is pivoted relative to the base 12 to move the plunger 16 along the rectilinear path, the lever 18 can pivot until the top edges 74, 76 and top surface 72 abut and contact (or be immediately adjacent to) an edge 78 of the plunger sleeve 42. The end 44 of the plunger 16 can slide along the top surface 72 during pivoting movement of the lever 18 to inhibit and/or eliminate loading and stress on the plunger 16 in a direction transverse to the rectilinear path.

Figure 9:
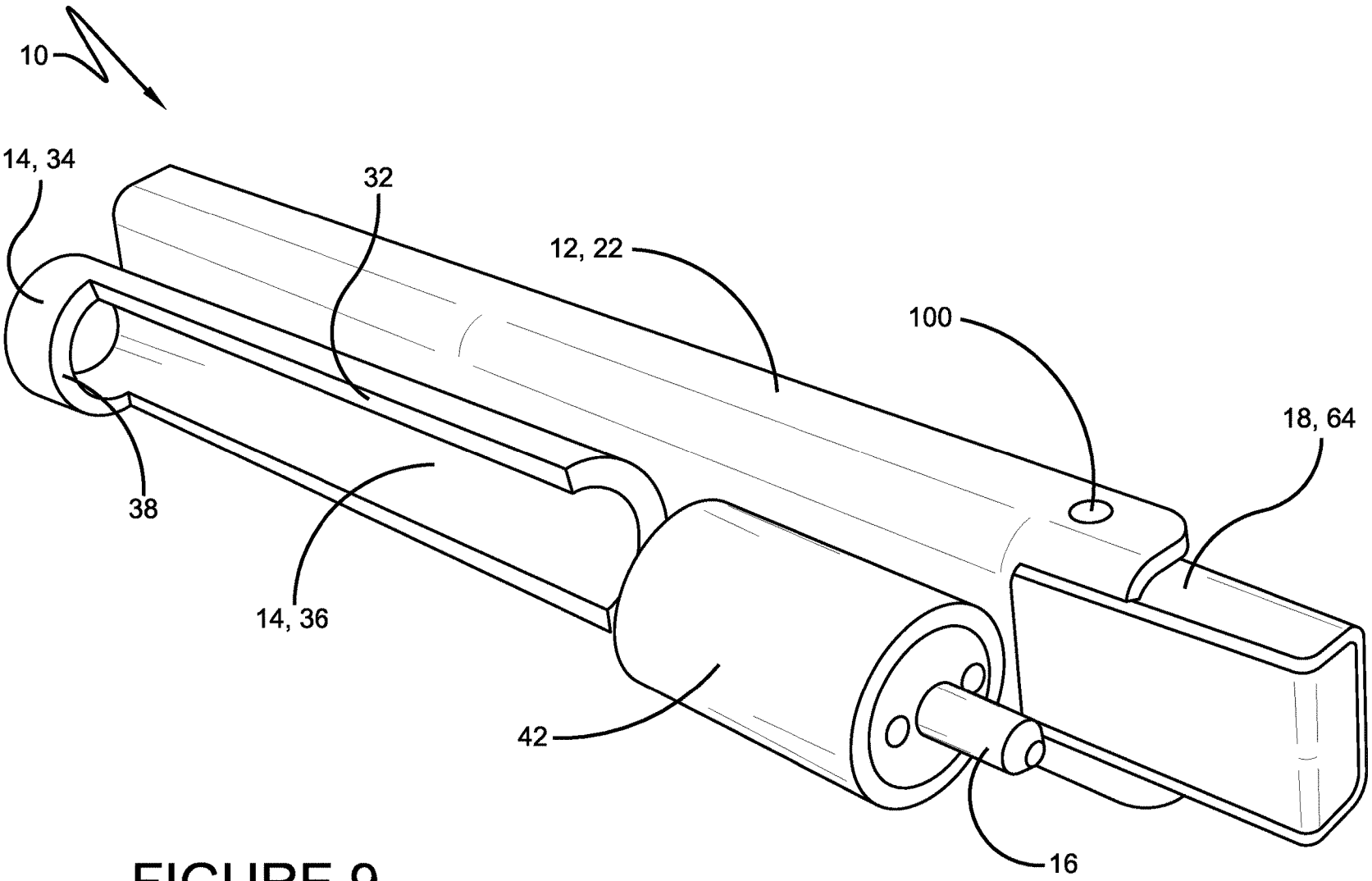
FIG. 9 is a ninth perspective view of the hinge pin extractor shown in FIGS. 1-8, taken from of a generally front side of the hinge pin extractor and showing the hinge pin extractor in a standby configuration.

The exemplary embodiment of the present disclosure defines an integrated tool rather than a tool requiring assembly before use. As shown in FIGS. 8 and 9, when in a standby configuration, the exemplary hinge pin extractor 10 can define a generally cubic structure that can be received in a holder. FIG. 12 shows the hinge pin extractor 10 positioned on the hinge assembly 84 in a working configuration. It is noted that the hinge pin extractor 10 will be adjusted by shifting the receiver 14 relative to the base 12 so that the plunger sleeve 42 abuts and contacts (or is proximate to) the lowest knuckle 98 of the hinge assembly 84. FIG. 13 illustrates the hinge pin extractor 10 positioned on a hinge in a working configuration and already adjusted to conform to the size of the hinge assembly 84.

Figure 14:
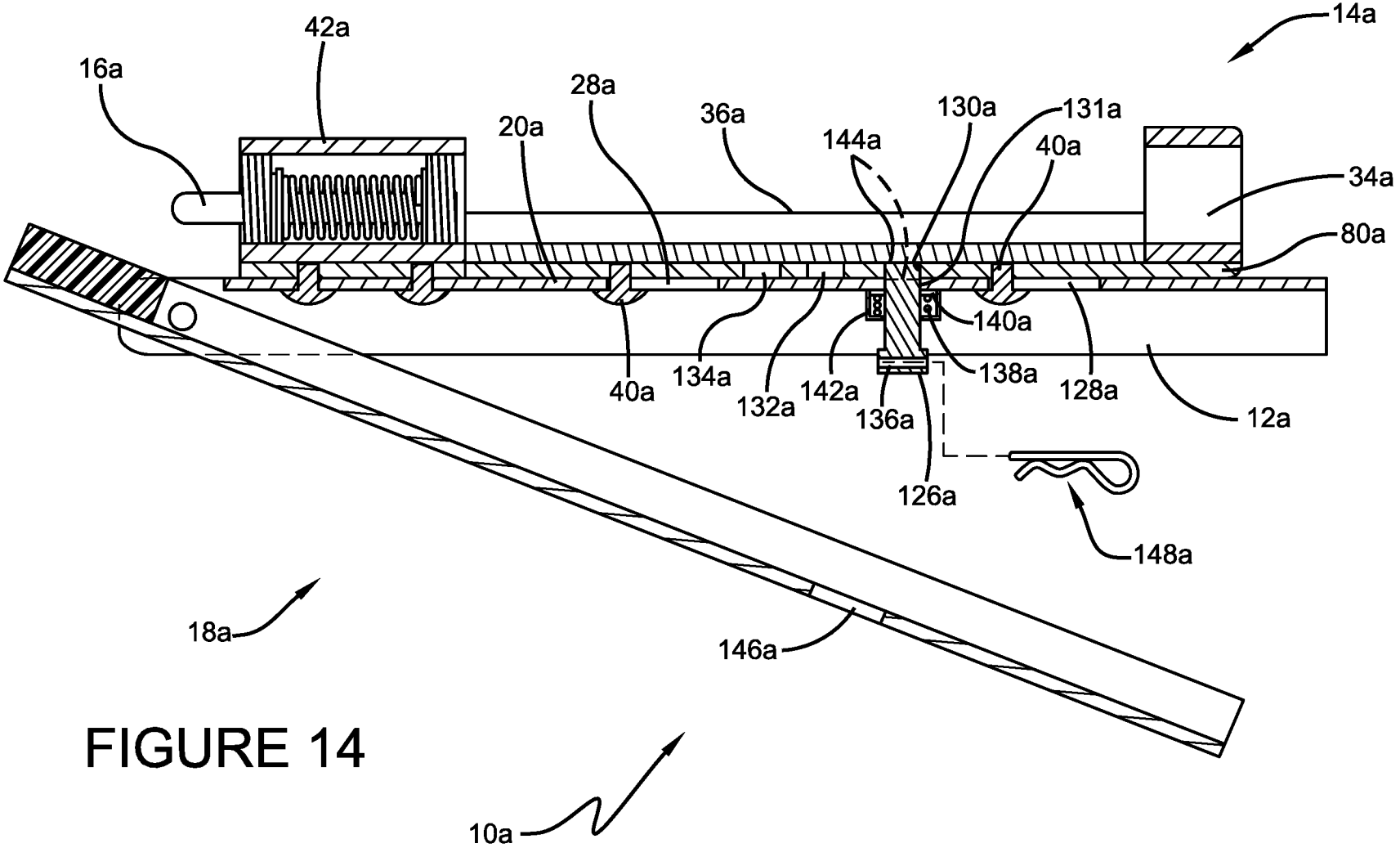
FIG. 14 is a cross-sectional view of a hinge pin extractor according to another exemplary embodiment of the present disclosure.

FIG. 14 is a cross-sectional view of a hinge pin extractor 10*a* according to another exemplary embodiment of the present disclosure. The hinge pin extractor 10*a* can include a base 12*a*, a hinge receiver 14*a*, a plunger 16*a*, and a lever 18*a*. The hinge receiver 14*a* can include a first portion 34*a* and a second portion 36*a*. In this exemplary embodiment, the first portion 34*a* and the second portion 36*a* can be separately formed components. The exemplary hinge receiver 14*a* can also include a plate member 80*a*. The first portion 34*a* and the second portion 36*a* can be fixed to the plate member 80*a*. The plate member 80*a* can be attached to the base 12*a* for sliding movement. By way of example and not limitation, the first portion 34*a* and the second portion 36*a* can be fixed to the plate member 80*a* by welding and then the plate member 80*a* can be attached to the base 12*a* with fasteners 40*a*. The fasteners 40*a* can be received in slots 28*a* and 128*a* for movement between the lateral ends of the slots 28*a*, 128*a*. The plurality of slots 28*a*, 128*a* are spaced from one another along a bottom portion 20*a* of the base 12*a* and direct movement of the hinge receiver 14*a*.

This embodiment can simplify manufacturing. For example, the portion 36*a* can be formed by cutting a cylindrical tube in half along its longitudinal length (resulting in two portions 36*a* for two devices 10*a*). The portion 34*a* can be formed by cutting desired lengths from a cylindrical tube. The plate member 80*a*, the portion 34*a*, and the portion 36*a* can be held in a fixture and welded together.

FIG. 14 also shows that the hinge pin extractor 10*a* can also include a releasable locking mechanism for selectively preventing sliding movement of the plate member 80*a*. The locking mechanism can include a pin 126*a* mounted to the base 12*a* for rectilinear movement between first and second end limits of travel. The pin 126*a* is received in an aperture 131*a* of the base 12*a*. The first end limit of travel is shown in solid line and corresponds to the pin 126*a* being received in one of a plurality of first apertures 130*a*, 132*a*, 134*a* defined by the plate 80*a*. When received in one of the plurality of first apertures 130*a*, 132*a*, 134*a*, the locking pin 126*a* is in a first position. The second end limit of travel corresponds to a second position of the locking pin 126*a* and is defined when the pin 126*a* is withdrawn from the plate 80*a*, spaced from the plurality of first apertures 130*a*, 132*a*, 134*a*. This will be discussed in greater detail below. The pin 126*a* can also include a lateral aperture 136*a*, as shown in FIG. 14.

The locking mechanism can also include a biasing member in the form of a spring 138*a* biasing the pin to the first end limit of travel, the first position. The spring 138*a* can act between a c-clip 140*a* mounted on the pin 126*a* and a cap 142*a* that is fixed to the base 12*a*. The pin 126*a* includes a distal end 144*a*. The position of the distal end 144*a* when the pin 126*a* is at the second end limit of travel is shown in phantom (dash line).

The lever 18*a* includes an aperture 146*a* configured to receive a portion of the pin 126*a* whereby the lateral aperture 136*a* is exposed when the pin 126*a* is received in aperture 146*a* of the lever 18*a*. For example, when the lever 18*a* is folded into the base 12*a* when not being used (as shown in FIG. 8, referred to as a standby configuration), the end of the pin 126*a* opposite to the distal end 144*a* can protrude out of the aperture 146*a*. The locking mechanism can also include a cotter pin 148*a* received in the lateral aperture 136*a*. The cotter pin 148*a* can substantially lock the lever 18*a* in the standby configuration when received in the aperture 136*a*, when the locking pin 126*a* extends through the aperture 146*a*.

In use, if the hinge will not fit between the hinge receiver 14*a* and the plunger 16*a*, the user can place the hinge receiver 14*a* on the hinge, pull the pin 126*a* against the spring 138*a*, and pull the base 12*a* downward until the hinge fits between the hinge receiver 14*a* and the plunger 16*a*. The pin 126*a* can be pulled outward by grasping the cotter pin 148*a*. After fitting the hinge between the hinge receiver 14*a* and the plunger 16*a*, the cotter pin 148*a* can be released to allow the pin 126*a* to be received in one of the plurality of first apertures 130*a*, 132*a*, 134*a*. The cotter pin 148*a* can then be removed from the aperture 136*a*, freeing the lever 18*a* to be rotated about the pivot axis/fulcrum. The hinge receiver 14*a* can be adjusted so that the hinge is captured as closely as possible between the hinge receiver 14*a* and a plunger sleeve 42*a*.

Figure 15:
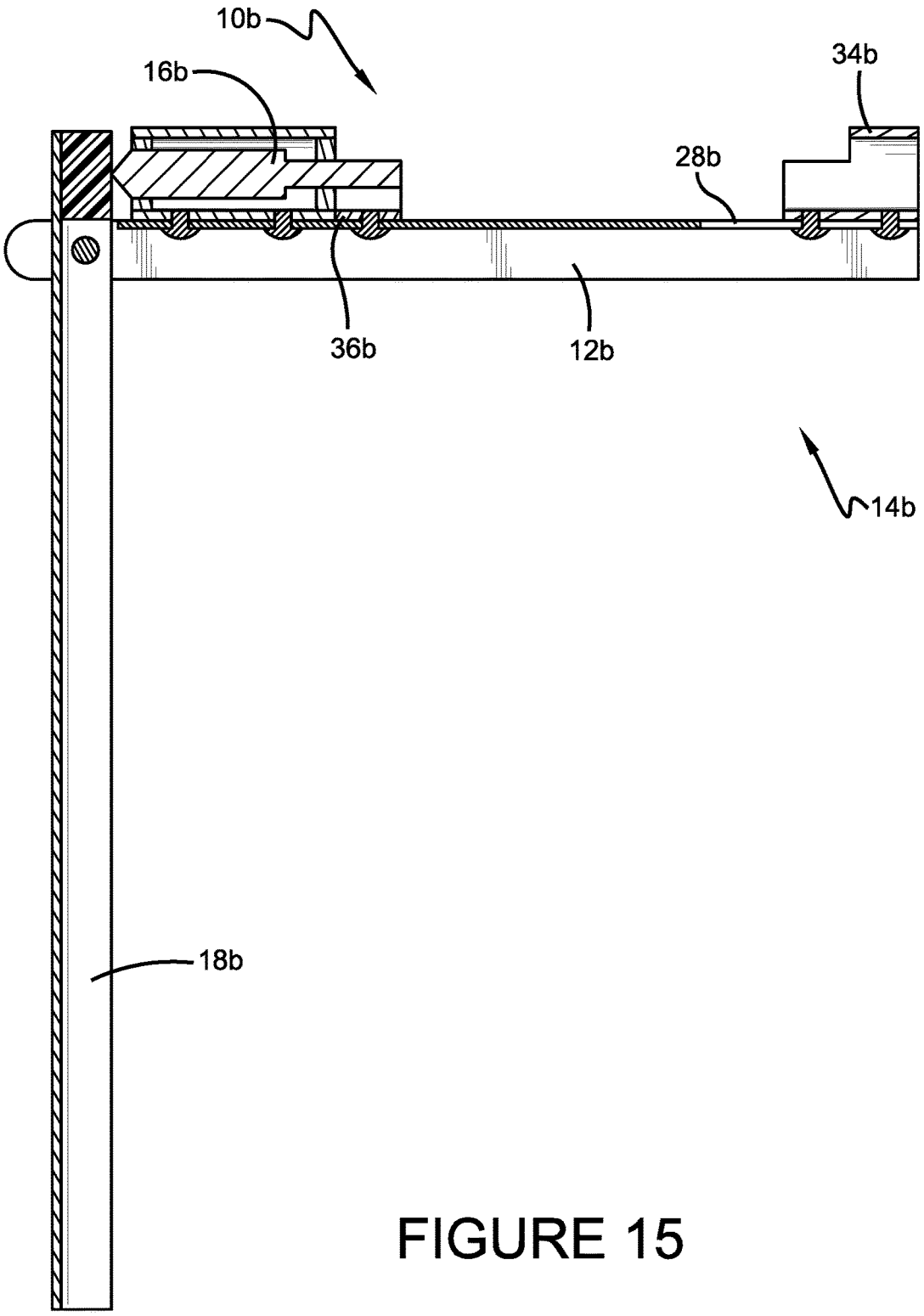
FIG. 15 is a cross-sectional view of a hinge pin extractor according to another exemplary embodiment of the present disclosure.

FIG. 15 is a cross-sectional view of a hinge pin extractor 10*b* according to another exemplary embodiment of the present disclosure. The hinge pin extractor 10*b* can include a base 12*b*, a hinge receiver 14*b*, a plunger 16*b*, and a lever 18*b*. The hinge receiver 14*b* can include a first portion 34*b* and a second portion 36*b*. The portion 34*b* of the hinge receiver 14*b* is interconnected with the base 12*b* through a slot 28*b*. The plunger 16*b* and the portion 36*b* can be interconnected with the base 12*b* with fasteners passing through apertures in the base 12*b* as shown in FIG. 15.

Figure 16:
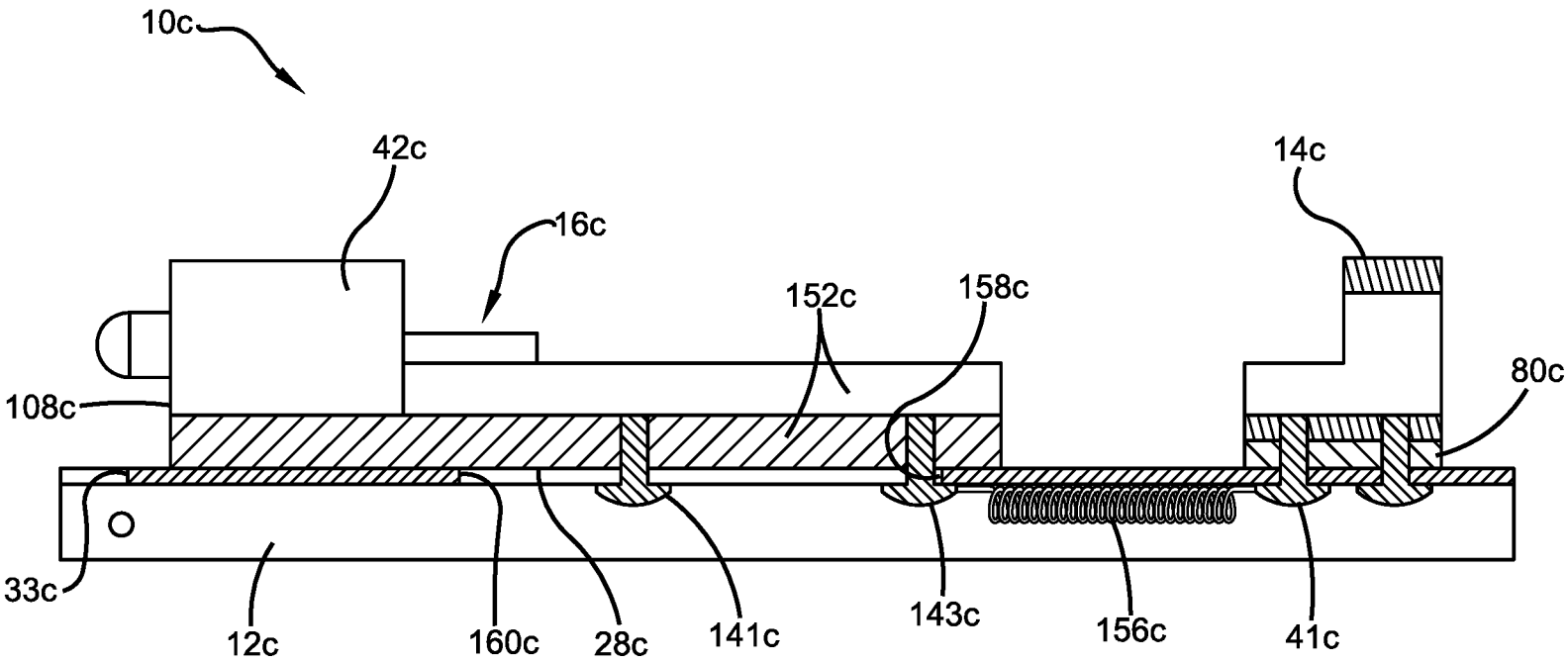
FIG. 16 is a partial cross-section of another embodiment of the present disclosure.
Figure 17:
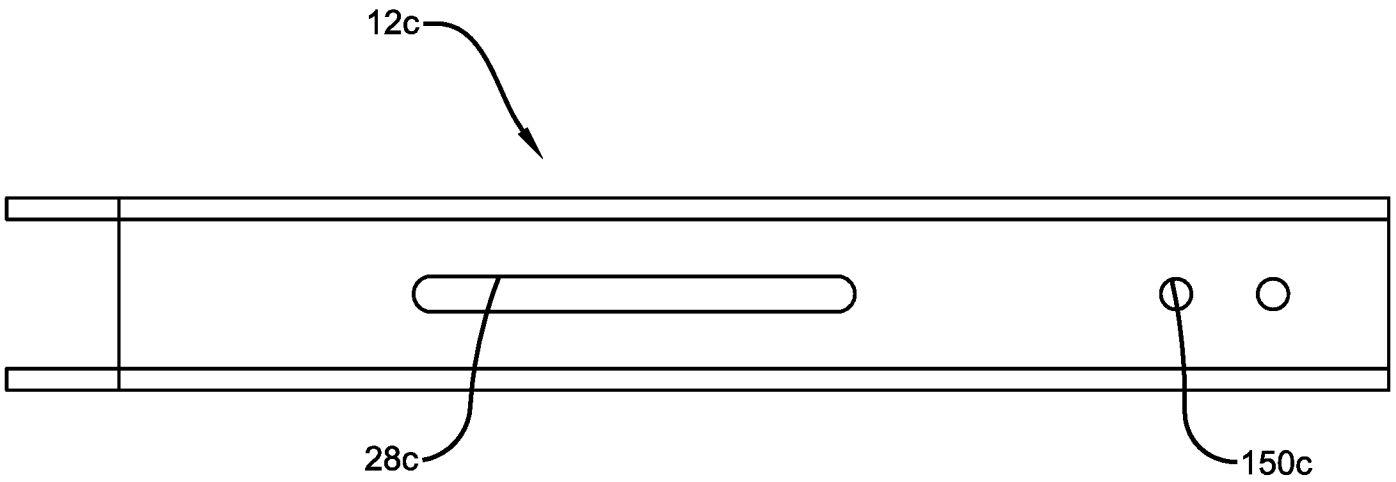
FIG. 17 is a top view of a base of the embodiment of the present disclosure shown in FIG. 16.
Figure 18:
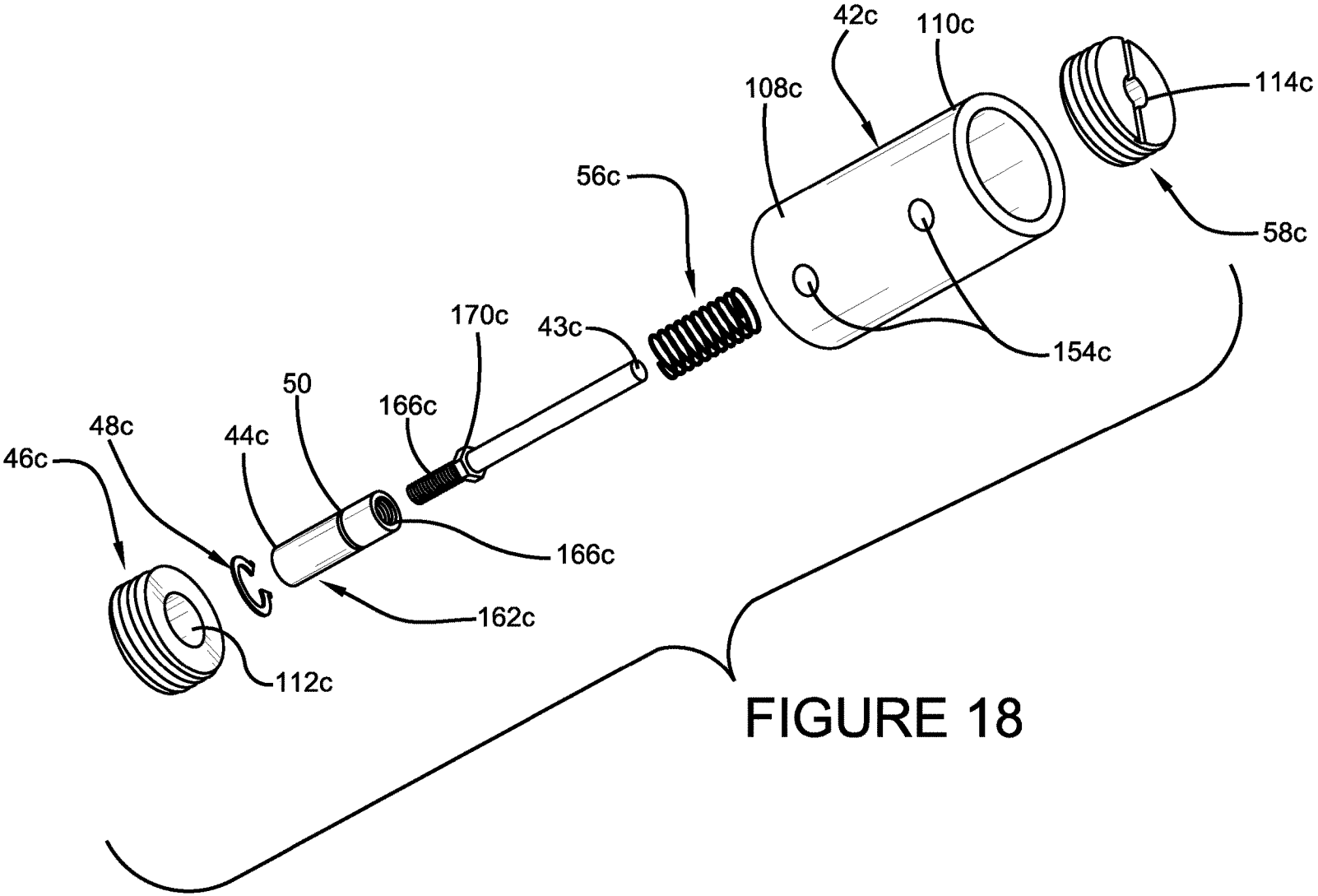
FIG. 18 is an exploded view of a plunger assembly of the embodiment of the present disclosure shown in FIG. 16.

FIG. 16-18 disclose another embodiment of the present disclosure. FIG. 16 is a partial cross-sectional view of a hinge pin extractor 10*c*, some structures have been sections and others have not. The hinge pin extractor 10*c* can include a base 12*c*, a hinge receiver 14*c*, a plunger 16*c*, and a lever (such as lever 18 or 18*a*). The exemplary hinge receiver 14*c* is fixed to a plate member 80*c*. The exemplary hinge receiver 14*c* and exemplary plate member 80*c* are fixed to the base 12*c* with fasteners 41*c*. The fasteners 41*c* pass through apertures 150*c* in the base 12*c* and fix the position of the exemplary hinge receiver 14*c* on the base 12*c*.

A plunger assembly of the hinge pin extractor 10*c* includes the plunger 16*c* and a plunger sleeve 42*c*. The exemplary plunger sleeve 42*c* is fixed to a guide member 152*c* having a c-shaped cross-section in plane perpendicular to the central longitudinal axis of the plunger 16*c*, similar to the second portion 36. The guide member 152*c* can partially encircle knuckles of the hinge assembly when the hinge pin extractor 10*c* is mounted on a hinge assembly. The exemplary plunger sleeve 42*c* is fixed to the exemplary guide member 152*c* with fasteners. These fasteners can pass through the exemplary guide member 152*c* and be received in apertures in the exemplary plunger sleeve 42*c*, such as the aperture referenced at 154*c* in FIG. 18.

The exemplary guide member 152*c* is attached to the base 12*c* for sliding movement. By way of example and not limitation, base 12*c* includes a slot 28*c*. Fasteners 141*c*, 143*c* are received in the slot 28*c* for movement between the lateral ends of the slots 28*a*, 128*a*. The slot 28*c* directs movement of the guide member 152*c* along the base 12*c*, and thus also directs movement of the plunger assembly and the plunger 16*c*.

A biasing member 156*c* is engaged to both of the hinge receiver 14*c* and the plunger 16*c*. The biasing member 156*c* urges the hinge receiver 14*c* and the plunger 16*c* together. Since the exemplary hinge receiver 14*c* is fixed in position, the exemplary biasing member 156*c* urges the guide member 152*c* and plunger assembly toward the hinge receiver 14*c*. The exemplary biasing member 156*c* is engaged with the hinge receiver 14*c* through the fastener 41*c* and engaged with the plunger 16*c* through the fastener 143*c*, the guide member 152*c* and the plunger sleeve 42*c*. The exemplary plunger 16*c* is freely slidable relative to said slot 28*c* while retained to the base 12*c* between first and second end limits of travel. A first end limit of travel is defined when the fastener 143*c* abuts a first end 158*c* of the slot 28*c*. A second end limit of travel is defined when the fastener 141*c* abuts a second end 160*c* of the slot 28*c*. The exemplary biasing member 156*c* urges the plunger 16*c* toward the first end limit of travel and is defined as a coil spring.

In use, if the hinge will not fit between the hinge receiver 14*c* and the plunger 16*c*, the user can place the hinge receiver 14*c* on the hinge assembly, pull the plunger sleeve 42*c* or the guide member 152*c* downward, against the biasing member 156*c*, until the hinge knuckles fit between the hinge receiver 14*c* and the plunger 16*c*. After fitting the hinge between the hinge receiver 14*c* and the end 43*c* of the plunger 16*c*, the guide member 152*c* or sleeve 42*c* (whichever has been grasped) can be released, allowing the biasing member 156*c* to draw the sleeve 42*c* toward the hinge receiver 14*c*. The lever can then be pivoted to engage and move the plunger 16*c*. The end 43*c* can be received in the knuckles when the guide member 152*c* or sleeve 42*c* (whichever has been grasped) has been released, before the lever has been pivoted.

With reference to the perspective of FIG. 16, it is noted that during adjustment to receive hinge knuckles, the plunger sleeve 42*c*, guide member 152*c* and plunger 16*c* can be moved to the left such that the end 108*c* of the plunger sleeve 42*c* moves past the end 33*c* of the base 12*c*. When the plunger sleeve 42*c* is released after the hinge knuckles have been received in between the hinge receiver 14*c* and the plunger 16*c*, the plunger sleeve 42*c*, guide member 152*c* and plunger 16*c* can be moved to the right by the biasing member 156*c*.

FIG. 18 illustrates components internal of the plunger sleeve 42*c*. A c-clip 48*c* can be mounted in a groove 50*c* of the plunger 16*c*. The c-clip 48*c* can define a shoulder fixedly engaged with the plunger 16*c* and positioned in the sleeve 42*c*. In various embodiments of the present disclosure, a shoulder can be integrally-formed on the plunger 16*c* or can be a separate structure mounted on the plunger 16*c*, such as c-clip 48*c*.

The components internal of the plunger sleeve 42*c* can be enclosed with a cap 46*c* and a cap 58*c*. The first end cap 46*c* can have a first aperture 112*c* and can substantially close a first end 108*c* of the sleeve 42*c*. The second end cap 58*c* can have a second aperture 114*c* and can substantially close the second end 110*c* of the sleeve 42*c*. The exemplary plunger 16*c* is disposed in the sleeve 42*c* and is sized to pass through both of the first aperture 112*c* and the second aperture 114*c*.

The exemplary plunger 16*c* further comprises an aft portion 162*c* and a forward portion 164*c*. The aft portion 162*c* defines the aft end 44*c* of the exemplary plunger 16*c* that is engaged by the lever and passes through the aperture 112*c*. The forward portion 164*c* defines a forward end 43*c* of the exemplary plunger 16*c* that is configured to engage the pin of the hinge assembly and passes through the aperture 114*c*. The exemplary aft portion 162*c* and forward portion 164*c* are releasably engaged with one another.

The exemplary aft portion 162*c* and the exemplary forward portion 164*c* have different diameters. The exemplary aft portion 162*c* has a thicker diameter than the exemplary forward portion 164*c* and can be more robust for receiving the load from the lever and in guiding the plunger 16*c* in straight, rectilinear movement. The exemplary forward portion 164*c* has a thinner diameter than the exemplary aft portion 162*c* to engage hinge pins surrounded by knuckles with smaller openings. It is noted that the apertures 112*c* and 114*c* can be sized differently so that each is slightly larger than the portions 162*c*, 164*c*, respectively.

The exemplary aft portion 162*c* and the exemplary forward portion 164*c* have different lengths. In some hinge assemblies, the forward end 43*c* must extend relatively far into the hinge knuckles to engage the pin. Thus, the exemplary forward portion 164*c* is longer than the exemplary aft portion 162*c*.

The exemplary forward portion 164*c* includes outwardly-facing threads 166*c*. The exemplary aft portion 162*c* includes inwardly-facing threads 168*c*. The exemplary aft portion 162*c* and the exemplary forward portion 164*c* are threadingly engaged with one another through the outwardly-facing threads 166*c* and the inwardly-facing threads 168*c*. The engagement through threads allows differently-shaped portions to be engaged, so as to exchange a first forward portion with a longer or shorter second forward portion. The engagement through threads also allows a damaged portion of the plunger 16*c* to be replaced. A nut 170*c* is engaged with at least a portion of the outwardly-facing threads 166*c* and limits an extent of engagement between the exemplary aft portion 162*c* and the exemplary forward portion 164*c*.

An exemplary spring 56*c* is operably positioned between the c-clip 48*c* and the end cap 58*c* within the sleeve 42*c*. The spring 56*c* can bias the plunger 16*c* to the first end limit of travel. The c-clip 48*c* can prevent the plunger 16*c* from exiting the plunger sleeve 42*c* through the cap 46*c*.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or sub-combinations that are disclosed herein as other present disclosures in other patent documents is hereby unconditionally reserved.

What is claimed is:

1. A hinge pin extractor operable to urge a pin out of engagement with a hinge assembly and comprising:

a base;

a receiver mounted to said base and configured to engage at least one of a first plate, a second plate, and at least one knuckle of the hinge assembly, said receiver sized to allow pass-through of the pin as the pin exits the at least one knuckle;

a plunger mounted to said base for movement along a rectilinear path between a first end limit of travel and a second end limit of travel and configured to urge the pin of the hinge assembly out of engagement with the at least one knuckle during movement from said first end limit of travel to said second end limit of travel;

a lever pivotally engaged with said base and disposed to engage said plunger to transmit motion to said plunger and thereby move said plunger along said rectilinear path; and wherein said lever and said base and said plunger are engaged such that pivoting motion of said lever is transmitted to rectilinear motion of said plunger through a single, fixed fulcrum positioned directly in said base.

2. The hinge pin extractor of claim 1 wherein a first of said receiver and said plunger is moveably mounted to said base.

3. The hinge pin extractor of claim 2 wherein a second of said receiver and said plunger is fixedly positioned on said base.

4. The hinge pin extractor of claim 2 wherein said base further comprises:

at least one slot, said at least one slot directing movement of said first of said receiver and said plunger moveably mounted to said base.

5. The hinge pin extractor of claim 4 wherein said at least one slot is further defined as a plurality of slots spaced from one another.

6. The hinge pin extractor of claim 5 wherein said plurality of slots are further defined as spaced from one another along a bottom portion of said base.

7. The hinge pin extractor of claim 4 further comprising:

at least one fastener extending through said at least one slot and fixed with said first of said receiver and said plunger moveably mounted to said base.

8. The hinge pin extractor of claim 2 further comprising:

at least one biasing member engaged to both of said receiver and said plunger and urging said receiver and said plunger together.

9. The hinge pin extractor of claim 8 wherein said first of said receiver and said plunger is further defined as freely slidable while retained to said base between first and second end limits of travel and said at least one biasing member urges said first of said receiver and said plunger to one of said first and second end limits of travel.

10. The hinge pin extractor of claim 8 wherein said at least one biasing member is further defined as a coil spring.

11. The hinge pin extractor of claim 2 further comprising:

at least one first aperture defined in said first of said receiver and said plunger moveably mounted to said base;

a second aperture defined in said base; and a locking pin received in said second aperture defined in said base and selectively received in said at least one first aperture, said locking moveable between a first position wherein said locking pin is received in said at least one first aperture and said second aperture and a second position wherein said locking pin is received in said second aperture and spaced from said at least one first aperture, said locking pin locking said base and said first of said receiver and said plunger moveably mounted to said base together when in said first position, and said first of said receiver and said plunger moveably mounted to said base freely moveable relative to said base when said locking pin is in said second position.

12. The hinge pin extractor of claim 11 further comprising:

a biasing member biasing said locking pin toward said first position.

13. The hinge pin extractor of claim 11 wherein said at least one first aperture is further defined as a plurality of first apertures whereby said locking pin is operable to lock said first of said receiver and said plunger in a plurality of different positions relative to said base.

14. The hinge pin extractor of claim 11 further comprising:

a third aperture defined is said lever, wherein said locking pin is extendable through said third aperture when said lever is in a standby configuration.

15. The hinge pin extractor of claim 14 further comprising:

a fourth aperture defined in said locking pin;

a cotter pin selectively receiveable in said fourth aperture, said cotter pin operable to substantially lock said lever in said standby configuration when received in said fourth aperture and when said locking pin extends through said third aperture.

16. The hinge pin extractor of claim 1 wherein said plunger further comprises:

an aft portion defining an aft end of said plunger engaged by said lever; and a forward portion defining a forward end of said plunger configured to engage the pin of the hinge assembly, wherein said aft portion and said forward portion are releasably engaged with one another.

17. The hinge pin extractor of claim 16 wherein said aft portion and said forward portion have different diameters.

18. The hinge pin extractor of claim 16 wherein said aft portion and said forward portion have different lengths.

19. The hinge pin extractor of claim 16 wherein a first of said aft portion and said forward portion includes outwardly-facing threads, a second of said aft portion and said forward portion includes inwardly-facing threads, and said aft portion and said forward portion are threadingly engaged with one another through said outwardly-facing threads and said inwardly-facing threads.

20. The hinge pin extractor of claim 19 further comprising: a nut engaged with at least a portion of said outwardly-facing threads and limiting an extent of engagement between said first of said aft portion and said forward portion and said second of said aft portion and said forward portion.

* * * * *